US006456175B1

(12) United States Patent
Kivelä

(10) Patent No.: US 6,456,175 B1
(45) Date of Patent: Sep. 24, 2002

(54) HELICAL AND COAXIAL RESONATOR COMBINATION

(75) Inventor: Marko Kivelä, Oulu (FI)

(73) Assignee: Nokia Networks Oy, Espoo (FI)

( * ) Notice: Subject to any disclaimer, the term of this patent is extended or adjusted under 35 U.S.C. 154(b) by 0 days.

(21) Appl. No.: 09/673,764

(22) PCT Filed: Apr. 21, 1999

(86) PCT No.: PCT/FI99/00322

§ 371 (c)(1),
(2), (4) Date: Oct. 20, 2000

(87) PCT Pub. No.: WO99/56340

PCT Pub. Date: Nov. 4, 1999

(30) Foreign Application Priority Data

Apr. 24, 1998 (FI) ..... 980911

(51) Int. Cl.[7] ..... H01P 1/20; H01P 1/205; H01P 7/04

(52) U.S. Cl. ..... 333/219; 333/220; 333/202

(58) Field of Search ..... 333/219, 220, 333/202

(56) References Cited

U.S. PATENT DOCUMENTS

| | | | | |
|---|---|---|---|---|
| 5,432,489 A | * | 7/1995 | Yrjola | 333/202 |
| 5,903,609 A | | 5/1999 | Kool et al. | 375/261 |
| 6,208,095 B1 | * | 3/2001 | DiVergilio et al. | 315/505 |

FOREIGN PATENT DOCUMENTS

| | | |
|---|---|---|
| EP | 0441 513 | 8/1991 |
| EP | 0 455 505 | 11/1991 |
| EP | 0 560 503 | 9/1993 |
| EP | 0 567 266 | 10/1993 |
| EP | 0 660 435 | 6/1995 |
| FI | 84211 | 7/1991 |
| FI | 84674 | 9/1991 |
| FI | 90478 | 10/1993 |
| FI | 91116 | 1/1994 |
| FI | 94914 | 7/1995 |
| WO | WO 97/29576 | 8/1997 |
| WO | WO 97/41671 | 11/1997 |

* cited by examiner

*Primary Examiner*—Robert Pascal
*Assistant Examiner*—Stephen E. Jones
(74) *Attorney, Agent, or Firm*—Pillsbury Winthrop LLP

(57) ABSTRACT

The present invention relates to a resonator assembly (1) comprising a helix resonator (2) consisting of a conductor wound as a cylindrical coil, and a housing (4) at least partly made conductive material and enveloping the helix resonator. In order to provide a resonator assembly with a better Q factor without the resonator assembly consequently significantly increasing in size, the conductor forming the cylindrical coil (2) continues as a straight conductor part (3), which extends from the cylindrical coil (2) substantially in the direction of the longitudinal axis (7) of the cylindrical coil, whereby said straight part constitutes a coaxial resonator. Further, a housing (4) envelopes the resonator formed by a combination of the helix resonator (2) and the coaxial resonator (3).

4 Claims, 1 Drawing Sheet

HELICAL AND COAXIAL RESONATOR COMBINATION

Figure 1:
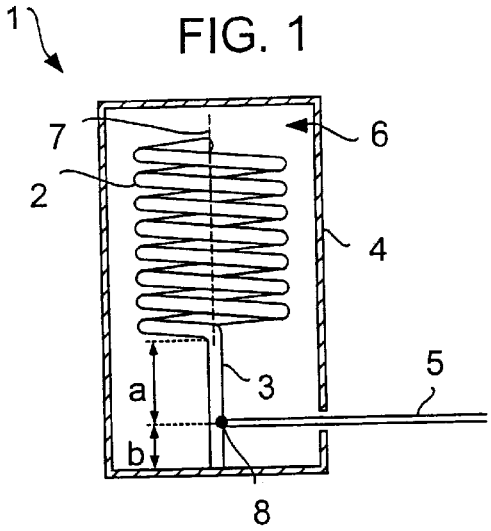

The present invention relates to a resonator assembly comprising a helix resonator consisting of a conductor wound as a cylindrical coil, and a housing at least partly made of conductive material and enveloping the helix resonator.

The present invention relates primarily to resonators used in filters of mobile telephone systems, although the invention can also be utilized in other contexts. Hereinafter, however, the invention will be described by way of example particularly with reference to mobile telephone systems.

A straight quarter wave resonator is previously known comprised of a straight conductor inserted into a metal housing. Such a resonator is suited for use in filters of mobile telephone system, for example. In the GSM system (Global System for Mobile communications), for example, wherein the frequencies used are approximately 900 Mhz, such a quarter wave coaxial resonator is about 80 mm long. As components become smaller and smaller, in practice, a resonator of the size described above has turned out to be too big. A solution for decreasing the resonator length has been to equip the resonator with a "cap" enabling the length of the straight part of the resonator to be decreased, based on the fact that the cap loads the resonator by lowering the frequency back to the 900 Mhz area. High capacitance between the cap and the resonator cavity, however, causes the quality factor, i.e. Q factor, to drop sharply. Sometimes a resonator assembly of this kind thus fails to produce high quality factors required by the resonators of base station filters, for example.

Furthermore, a resonator called a helix resonator is also previously known comprising a quarter wave long resonator wound as a cylindrical coil. The resonator is then comprised of a conductor wound to form a coil of cylindrical form using thread or section wire. The helix resonator is inserted into a housing of conductive material serving as a ground plane, one end of the resonator being coupled thereto. The other end of the helix resonator is left open. The helix resonator is significantly smaller than a coaxial resonator with corresponding characteristics. However, the helix resonator suffers from the same problem, i.e. too low a quality factor, as the above-described straight coaxial resonator equipped with a cap.

An object the present invention is to solve the problem described above and provide a resonator assembly having a high quality factor and taking up a relatively small space. This aim is achieved by a resonator assembly of the invention comprising a helix resonator consisting of a conductor wound as a cylindrical coil, and characterized by the conductor that forms said cylinrical coil continuing as a straight conductor part, which extends from the cylindrical coil substantially in the direction of the longitudinal axis of the cylindrial coil, whereby said straight conductor part constitutes a coaxial resonator, and said housing enveloping the resonator formed by a combination of the helix resonator and the coaxial resonator.

The invention is based on the idea that combining a helix resonator and a straight coaxial resonator into one resonator provides a resonator assembly having significantly better characteristics than the known resonators. In the resonator assembly of the invention, the conductor forming the coil of the helix resonator can continue as a straight conductor part constituting a coaxial resonator, in other words the conductor can be the same physical wire whose first end is shaped as a spiral and whose second end is shaped as a straight conductor part. Alternatively, the conductors can be two separate wires coupled with each other in a manner known per se, for example by soldering. Hence, one wire is shaped as a spiral and the other as a straight conductor part.

Practical experiments show that a resonator assembly comprised of a helix resonator and a straight coaxial resonator significantly enables space to be saved since the total length of the resonator assembly can thus be decreased, compared with the known straight coaxial resonator, without the quality factor, i.e. Q factor, of the resonator consequently being significantly lowered. Hence, the most significant advantage of the resonator assembly of the invention is that it is space-efficient without the resonator quality factor consequently being lowered. The resonator assembly of the invention is suited for use in RF filters, for example.

In a preferred embodiment of the resonator assembly of the invention the diameter of the conductor forming the helix resonator is different from the diameter of the conductor part forming the coaxial resonator. This embodiment of the invention enables an impedance change to take place at the joining point of the conductors where the diameter changes. Hence, a necessary impedance change in the assembly used can be provided by means of dimensioning.

Figure 2:
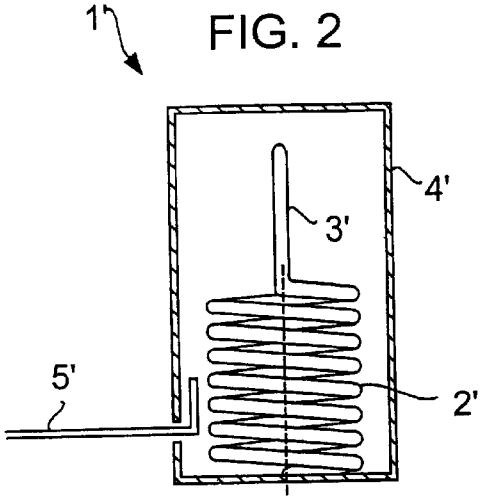
Figure 3A:
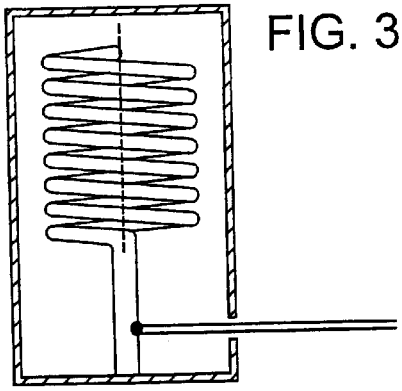
Figure 3B:
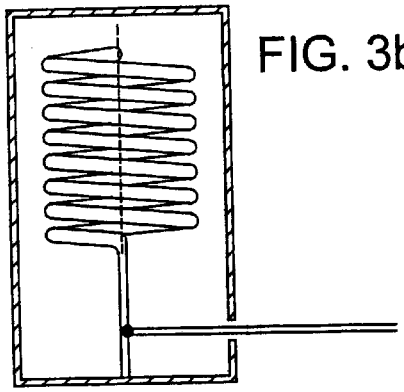
Figure 4A:
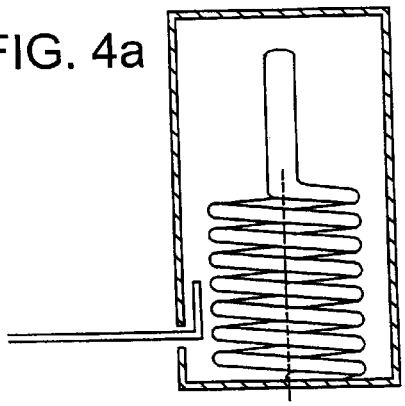
Figure 4B:
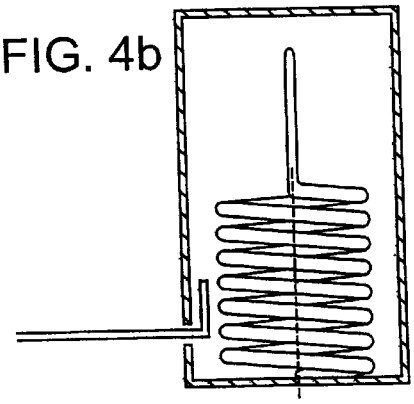

The preferred embodiments of the resonator assembly of the invention are disclosed in the attached dependent claims 2 and 3. In the following, the invention will be described in closer detail by way of example with reference to the accompanying drawings, in which FIG. 1 shows a first preferred embodiment of a resonator assembly in accordance with the invention, and FIG. 2 shows a second preferred embodiment of the resonator assembly of the invention, and FIGS. 3*a* and 3*b* show resonator assemblies corresponding to the one in FIG. 1 with the exception that the diameter of the conductor forming the helix resonator in FIGS. 3*a* and 3*b* is different from the diameter of the conductor part forming the coaxial resonator, and FIGS. 4*a* and 4*b* show resonator assemblies corresponding to the one in FIG. 2 with the exception that the diameter of the conductor forming the helix resonator in FIGS. 4*a* and 4*b* is different from the diameter of the conductor part forming the coaxial resonator.

FIG. 1 shows a first preferred embodiment of a resonator assembly in accordance with the invention. By way of example, the resonator assembly of FIG. 1 is assumed to be a resonator assembly used in an RF filter of a GSM system.

The resonator assembly shown in FIG. 1 comprises a helix resonator 2 connected directly to a coaxial resonator 3. The helix resonator 2 is comprised of wire wound as a cylindrical coil, the diameter of the wire being for example 4 to 8 mm. Suitable wire materials include silver-coated aluminum, copper or steel. A dash line 7 in FIG. 1 illustrates the longitudinal axis of the cylindrical coil.

The wire continues from the lower part of the cylindrical coil as a straight conductor part 3 projecting from the cylindrical coil substantially in the direction of the longitudinal axis 7 thereof. The conductor part 3 thus constitutes a straight coaxial resonator. In an RF filter of the GSM system, wherein the frequency of signals to be filtered is approximately 900 Mhz, the total height of a resonator assembly 1 can be 40 to 50 mm, for example, in which case the straight resonator 3 accounts for approximately 18 mm while the helix resonator 2 accounts for approximately 20 to 30 mm. Such dimensioning enables almost as high a quality factor as obtained by means of an 80-mm-long straight coaxial resonator.

The resonator assembly 1 of FIG. 1 thus comprises the resonator comprising the helix resonator 2 and the straight coaxial resonator 3 coupled to each other. The resonator is arranged in a housing 4 at least partly made of conductive material. In practice, at least the inner surface of the housing 4 should be of conductive material. In the case of FIG. 1, the housing 4 can be made of aluminum with an inner surface coated with silver. In order to couple an input conductor 5 to the resonator at a coupling point 8, the housing has an opening arranged therein. Signals to be filtered are fed to the resonator through the conductor 5.

When the resonator is quarter wave long, the total length of the conductor constituting the helix resonator and the coaxial resonator is $\lambda/4$ where $\lambda$ is the wave length. Hence, the coupling point 8 is, for example, disposed at such a point of the straight conductor part 3 that distance a from the helix resonator is approximately $a=\lambda/4*0.3$. Correspondingly, distance b from the coupling point 8 to a point at which the resonator is grounded is approximately $b=\lambda 4*0.1$. At the coupling point, the impedance of such an assembly is approximately 50Ω, and approximately 200Ω or more at an open top end 6 of the resonator. When necessary, the resonator assembly of FIG. 1 can effect an impedance change by using conductors with different diameter lengths in the helix resonator 2 and the straight coaxial resonator 3.

As distinct from the case of FIG. 1, the resonator assembly can also be such that the straight coaxial resonator is disposed uppermost and the helix resonator lowermost (as in the case of FIG. 2).

FIG. 2 shows a second preferred embodiment of the resonator assembly of the invention. A resonator assembly 1' of FIG. 2 is almost simifar to the resonator assembly of FIG. 1, but a helix resonator 2' is arranged underneath a coaxial resonator 2' in the resonator assembly 1'. In addition, a conductor 5' is not directly coupled to the resonator but signals to be filtered are fed capacitively from the conductor 5' to the resonator.

It is to be understood that the above description and the accompanying drawings are only intended to illustrate the present invention. It will be obvious to those skilled in the art that the invention can be modified in various ways without departing from the scope and spirit of the invention disclosed in the attached claims.

What is claimed is:

1. A resonator assembly comprising:

a helix resonator consisting of a conductor wound as a cylindrical coil, said cylindrical coil continuing as a straight conductor part, which extends from the cylindrical coil substantially in the direction of a longitudinal axis of the cylindrical coil; and a housing at least partly made of conductive material and enveloping the helix resonator, wherein said conductor part continuing as a straight conductor part constitutes a coaxial resonator, whose length accounts for approximately 40–60% of the total length of the resonator consisting of the helix resonator and the coaxial resonator, and said housing envelopes the resonator formed by a combination of the helix resonator and the coaxial resonator.

2. A RF filter including a resonator assembly comprising a helix resonator consisting of a conductor wound as a cylindrical coil, said cylindrical coil continuing as a straight conductor part, which extends from the cylindrical coil substantially in the direction of a longitudinal axis of the cylindrical coil, and a housing at least partly made of conductive material and enveloping the helix resonator, wherein said conductor part continuing as a straight conductor part constitutes a coaxial resonator, whose length accounts for approximately 40–60% of the total length of the resonator consisting of the helix resonator and the coaxial resonator, and said housing envelopes the resonator formed by a combination of the helix resonator and the coaxial resonator.

3. A resonator assembly comprising:

a helix resonator consisting of a conductor wound as a cylindrical coil, said cylindrical coil continuing as a straight conductor part, which extends from the cylindrical coil substantially in the direction of a longitudinal axis of the cylindrical coil; and a housing at least partly made of conductive material and enveloping the helix resonator, wherein said conductor part continuing as a straight conductor part constitutes a coaxial resonator, whose length accounts for approximately 40–60% of the total length of the resonator consisting of the helix resonator and the coaxial resonator, the diameter of the conductor forming the helix resonator being different from the diameter of the conductor part forming the coaxial resonator, and said housing envelopes the resonator formed by a combination of the helix resonator and the coaxial resonator.

4. A RF filter including a resonator assembly comprising a helix resonator consisting of a conductor wound as a cylindrical coil, said cylindrical coil continuing as a straight conductor part, which extends from the cylindrical coil substantially in the direction of a longitudinal axis of the cylindrical coil, and a housing at least partly made of conductive material and enveloping the helix resonator, wherein said conductor part continuing as a straight conductor part constitutes a coaxial resonator, whose length accounts for approximately 40–60% of the total length of the resonator consisting of the helix resonator and the coaxial resonator, the diameter of the conductor forming the helix resonator being different from the diameter of the conductor part forming the coaxial resonator, and said housing envelopes the resonator formed by a combination of the helix resonator and the coaxial resonator.

* * * * *